US011854484B2

(12) United States Patent
Son et al.

(10) Patent No.: US 11,854,484 B2
(45) Date of Patent: Dec. 26, 2023

(54) PIXEL CIRCUIT AND DISPLAY DEVICE INCLUDING THE SAME

(71) Applicant: LG Display Co., Ltd., Seoul (KR)

(72) Inventors: Ki Min Son, Paju-si (KR); Chang Hee Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/899,548

(22) Filed: Aug. 30, 2022

(65) Prior Publication Data

US 2023/0070020 A1 Mar. 9, 2023

(30) Foreign Application Priority Data

Sep. 3, 2021 (KR) ..... 10-2021-0117533
Dec. 10, 2021 (KR) ..... 10-2021-0176373

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01); *G09G 2300/0852* (2013.01)

(58) Field of Classification Search
CPC .. G09G 3/3258; G09G 3/3266; G09G 3/3291; G09G 2300/0852
See application file for complete search history.

(56) References Cited

U.S. PATENT DOCUMENTS

2006/0077134 A1* 4/2006 Hector ..... G09G 3/3233 345/76
2010/0073344 A1* 3/2010 Ohhashi ..... H01L 21/6719 345/76
2014/0168290 A1* 6/2014 Yang ..... G09G 3/3233 345/691
2018/0190199 A1* 7/2018 Chun ..... H10K 59/131
2020/0211457 A1* 7/2020 Kim ..... G09G 3/3233
2021/0020734 A1* 1/2021 Yokoyama ..... G09F 9/30
2021/0035490 A1* 2/2021 Feng ..... G09G 3/32

FOREIGN PATENT DOCUMENTS

KR 10-2016-0074772 A 6/2016
KR 10-2018-0078476 A 7/2018

* cited by examiner

*Primary Examiner* — Matthew A Eason
*Assistant Examiner* — Sujit Shah
(74) *Attorney, Agent, or Firm* — Seed IP Law Group LLP

(57) ABSTRACT

A pixel circuit and a display device including the same are disclosed. The pixel circuit of the present disclosure includes: a driving element including a first electrode connected to a first node to which a pixel driving voltage is applied, a gate electrode connected to a second node, and a second electrode connected to a third node; a first switch element configured to supply a data voltage of pixel data to a fourth node in response to a scan pulse; a second switch element configured to supply an initialization voltage to the second node in response to a first initialization pulse; a third switch element configured to supply a reference voltage lower than the initialization voltage to the third node in response to a sensing pulse; and a fourth switch element configured to supply the reference voltage to the fourth node in response to a second initialization pulse.

20 Claims, 12 Drawing Sheets

PIXEL CIRCUIT AND DISPLAY DEVICE INCLUDING THE SAME

CROSS-REFERENCE TO RELATED APPLICATION

This application claims priority to and the benefit of Korean Patent Application No. 10-2021-0117533, filed Sep. 3, 2021 and Korean Patent Application No. 10-2021-0176373, filed Dec. 10, 2021, the disclosure of which is incorporated herein by reference in its entirety.

BACKGROUND

Technical Field

The present disclosure relates to a pixel circuit and a display device including the same.

Description of the Related Art

Electroluminescence display devices include both inorganic light-emitting display devices and organic light-emitting displays according to a material of an emission layer. An active matrix organic light-emitting display device includes an organic light-emitting diode (OLED) that generates light by itself and has advantages in terms of a high response rate, high luminous efficiency, high brightness, and a large viewing angle. In an organic light-emitting display device, an OLED is formed at each pixel. The organic light-emitting display device has a high response rate, high luminous efficiency, high brightness, and a large viewing angle and is capable of expressing black gradation in perfect black, thereby achieving a high contrast ratio and a high color reproduction rate.

In the case of an internal compensation circuit using a source-following circuit, a source node voltage changes as much as the threshold voltage of the driving element, and the change amount of the source node voltage may be transmitted to a gate node.

BRIEF SUMMARY

The inventors have realized that, when the amount of change in the source node voltage is transmitted to the gate node, a loss may occur due to the parasitic capacitance of the gate node. An error may occur in sensing the threshold voltage of the driving element because of a difference in the transmission rate at which the amount of change in the source node voltage is transmitted to the gate node.

Embodiments of the present disclosure solve the above-mentioned shortcomings and/or problems.

The present disclosure provides a pixel circuit and a display device including the same, capable of improving image quality by overcoming a compensation limit of a pixel circuit using a source following circuit.

The problems addressed by the embodiments of the present disclosure are not limited to those mentioned above, and other problems not mentioned will be clearly understood by those skilled in the art from the following description.

The pixel circuit according to an embodiment of the present disclosure may include: a driving element including a first electrode connected to a first node to which a pixel driving voltage is applied, a gate electrode connected to a second node, and a second electrode connected to a third node, and configured to supply a current to a light emitting element; a first switch element configured to supply a data voltage of pixel data to a fourth node in response to a scan pulse; a second switch element configured to supply an initialization voltage to the second node in response to a first initialization pulse; a third switch element configured to supply a reference voltage lower than the initialization voltage to the third node in response to a sensing pulse; a fourth switch element configured to supply the reference voltage to the fourth node in response to a second initialization pulse; a fifth switch element configured to connect the third node to an anode electrode of the light emitting element in response to an emission control pulse; a first capacitor connected between the second node and the fourth node; a second capacitor connected between the third node and the fourth node; and a third capacitor connected between the first node and the third node.

The display device of the present disclosure includes the pixel circuit.

In the present disclosure, the threshold voltage compensation performance of the driving element can be improved and the compensation range can be increased by using the first, second and third capacitors added to the pixel circuit using the source following method.

The effects of the present disclosure are not limited to those mentioned above, and other effects not mentioned will be clearly understood by those skilled in the art from the description of the claims.

BRIEF DESCRIPTION OF THE SEVERAL VIEWS OF THE DRAWINGS

The above and other objects, features, and advantages of the present disclosure will become more apparent to those of ordinary skill in the art by describing exemplary embodiments thereof in detail with reference to the attached drawings, in which.

DETAILED DESCRIPTION

Figure 1:
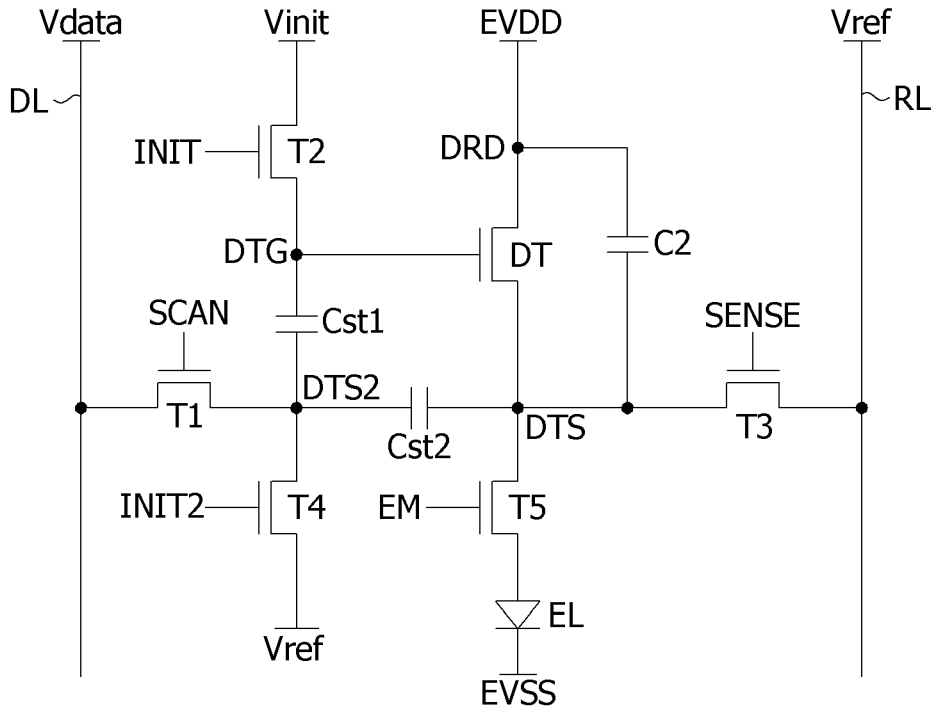
FIG. 1 is a circuit diagram illustrating a pixel circuit according to an embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The present disclosure is as broad as the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," "having," and "consist of" used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The same reference numerals may refer to substantially the same elements throughout the present disclosure.

The following embodiments can be partially or entirely bonded to or combined with each other and can be linked and operated in technically various ways. The embodiments can be carried out independently of or in association with each other.

Each of the pixels may include a plurality of sub-pixels having different colors to in order to reproduce the color of the image on a screen of the display panel. Each of the sub-pixels includes a transistor used as a switch element or a driving element. Such a transistor may be implemented as a TFT (Thin Film Transistor).

A driving circuit of the display device writes a pixel data of an input image to pixels on the display panel. To this end, the driving circuit of the display device may include a data driving circuit configured to supply data signal to the data lines, a gate driving circuit configured to supply a gate signal to the gate lines, and the like.

In a display device of the present disclosure, the pixel circuit and the gate driving circuit may include a plurality of transistors. Transistors may be implemented as oxide thin film transistors (oxide TFTs) including an oxide semiconductor, low temperature polysilicon (LTPS) TFTs including low temperature polysilicon, or the like. In embodiments, descriptions will be given based on an example in which the transistors of the pixel circuit and the gate driving circuit are implemented as the n-channel oxide TFTs, but the present disclosure is not limited thereto.

A transistor is a three-electrode element including a gate, a source, and a drain. The source is an electrode that supplies carriers to the transistor. In the transistor, carriers start to flow from the source. The drain is an electrode through which carriers exit from the transistor. In a transistor, carriers flow from a source to a drain. In the case of an n-channel transistor, since carriers are electrons, a source voltage is a voltage lower than a drain voltage such that electrons may flow from a source to a drain. In the n-channel transistor, a direction of a current is from the drain to the source. In the case of a p-channel transistor (p-channel metal-oxide semiconductor (PMOS), since carriers are holes, a source voltage is higher than a drain voltage such that holes may flow from a source to a drain. In the p-channel transistor, since holes flow from the source to the drain, a current flows from the source to the drain. It should be noted that a source and a drain of a transistor are not fixed. For example, a source and a drain may be changed according to an applied voltage. Therefore, the disclosure is not limited due to a source and a drain of a transistor. In the following description, a source and a drain of a transistor will be referred to as a first electrode and a second electrode.

A gate signal swings between a gate-on voltage and a gate-off voltage. The gate-on voltage is set to a voltage higher than a threshold voltage of a transistor, and the gate-off voltage is set to a voltage lower than the threshold voltage of the transistor.

The transistor is turned on in response to the gate-on voltage and is turned off in response to the gate-off voltage. In the case of an n-channel transistor, a gate-on voltage may be a gate high voltage, and a gate-off voltage may be a gate low voltage.

Hereinafter, various embodiments of the present disclosure will be described in detail with reference to the accompanying drawings. In the following embodiments, the display device will be mainly described with respect to the organic light emitting display device, but the present disclosure is not limited thereto. The present disclosure is not limited to the names of elements or signals in the following examples and claims.

Figure 2:
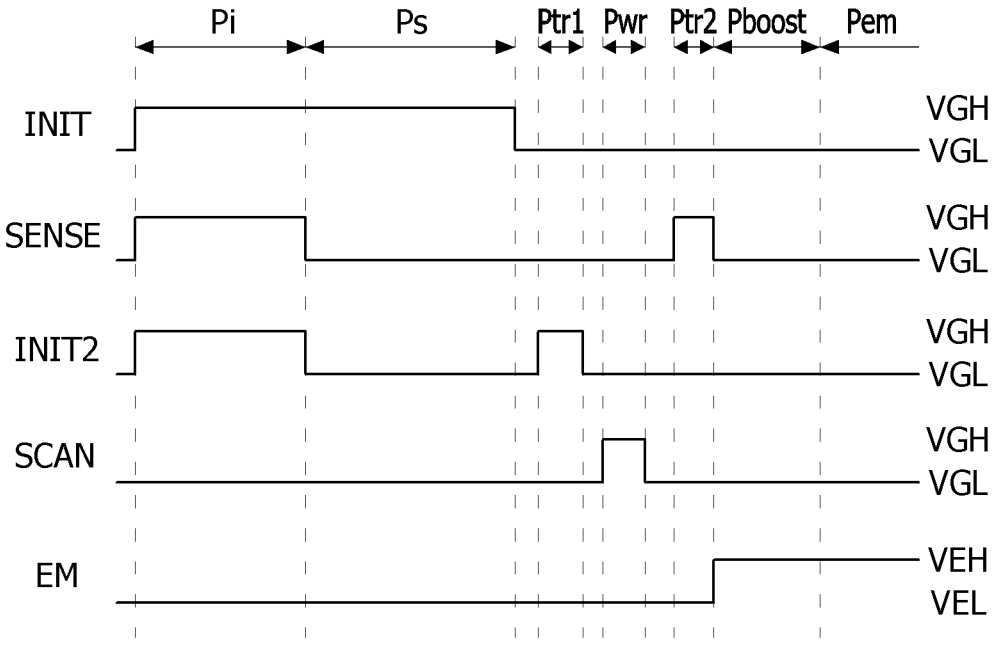
FIG. 2 is a waveform diagram illustrating a gate signal applied to the pixel circuit shown in FIG. 1.
Figure 3:
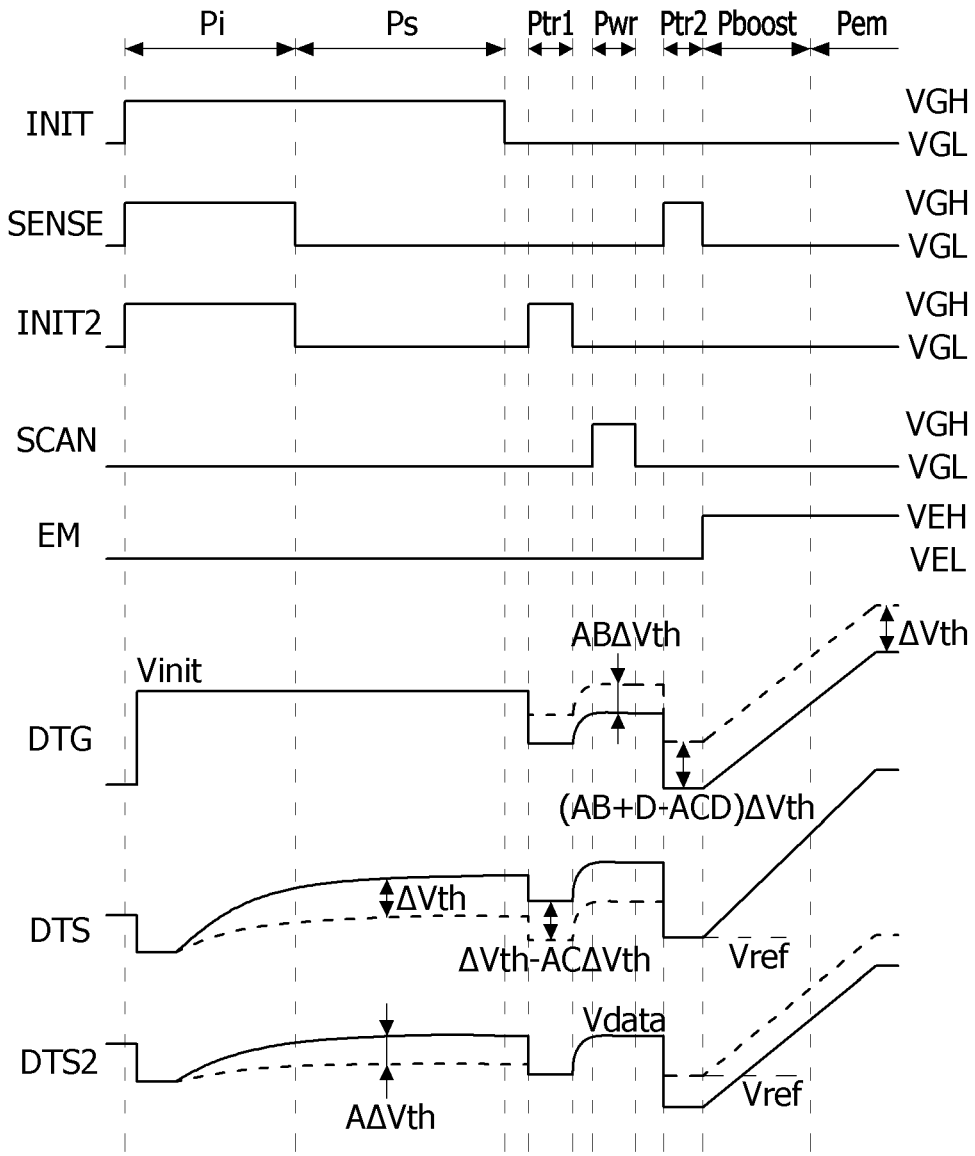
FIG. 3 is a waveform diagram illustrating voltage changes of main nodes of the pixel circuit shown in FIG. 1.

FIG. 1 is a circuit diagram illustrating a pixel circuit according to an embodiment of the present disclosure. FIG. 2 is a waveform diagram illustrating a gate signal applied to the pixel circuit shown in FIG. 1. FIG. 3 is a waveform diagram illustrating voltage changes of main nodes of the pixel circuit shown in FIG. 1. In FIG. 3, a solid line waveform of main nodes DTG, DTS, and DTS2 indicates an initial state in which a threshold voltage Vth of a driving element DT is not shifted, and a dotted line waveform thereof indicates an example in which the threshold voltage Vth of the driving element DT is shifted due to deterioration of the driving element DT according to the accumulation of driving time of pixels. FIGS. 4A to 4F are circuit diagrams illustrating the operation of the pixel circuit shown in FIG. 1 in steps.

Referring to FIGS. 1 to 4F, the pixel circuit includes a light emitting element EL, the driving element DT for driving the light emitting element EL, a plurality of switch elements T1 to T5, and first, second and third capacitors Cst1, Cst2, and C2. The driving element DT and the switch elements T1 to T5 may be implemented with n-channel oxide TFTs.

The pixel circuit is connected to a VDD line through which a pixel driving voltage EVDD is applied, a VSS line through which a low potential pixel reference voltage EVSS is applied, an INIT line through which an initialization voltage Vinit is applied, a REF line RL through which a reference voltage Vref is applied, a data line DL through which a data voltage Vdata is applied, and gate lines through which gate signals INIT, INIT2, SENSE, SCAN, and EM are applied.

The pixel driving voltage EVDD is higher than the data voltage Vdata, and is a voltage at which the driving element DT is able to operate in a saturation region. The pixel driving voltage EVDD is set to a voltage of EVSS+Vel+Vgs+Virmargin. "Vel" is an anode voltage of the light emitting element EL at which the light emitting element EL is driven with maximum brightness. "Vgs" is a gate-source voltage of the driving element DT. "Virmargin" is a margin voltage for compensating for IR drop of the pixel driving voltage EVDD due to a wiring resistance R on the display panel and a current I flowing through the pixels.

The initialization voltage Vinit may be set to a voltage obtained by adding the margin voltage in consideration of the threshold voltage compensation range of the driving element DT to the reference voltage Vref. The initialization voltage Vinit is higher than the reference voltage Vref. The reference voltage Vref is set to a low potential voltage close to the low potential pixel reference voltage EVSS. The reference voltage Vref may be lower than the low potential pixel reference voltage EVSS.

Gate-on voltages VGH and VEH of the gate signals INIT, INIT2, SENSE, SCAN, and EM may be higher than the pixel driving voltage EVDD, and may be set to a minimum gate-on voltage at which the data voltage Vdata is changeable within an expressible grayscale range in order to reduce power consumption. Gate-off voltages VGL and VEL of the gate signals INIT, INIT2, SENSE, SCAN, and EM may be lower than the low potential pixel reference voltage EVSS and the reference voltage Vref and may be set to a voltage of EVSS-margin.

As shown in FIGS. 2 and 3, the driving period of the pixel circuit includes and/or may be divided into an initialization step Pi, a sensing step Ps, a first transmission step Ptr1, a data writing step Pwr, a second transmission step Ptr2, a boosting step Pboost, and a light emission step Pem. In FIG. 3, "ΔVth" described in second to fourth nodes DTG, DTS, and DTS2 is an amount of voltage change the threshold voltage in the driving element DT.

In the initialization step Pi, a first initialization pulse INIT, a sensing pulse SENSE, and a second initialization pulse IINIT2 are generated as the gate-on voltage VGH. In the initialization step Pi, a scan pulse SCAN and an emission control pulse (hereinafter, referred to as "EM pulse") EM are the gate-off voltages VGL and VEL.

In the sensing step Ps, the first initialization pulse INIT is generated as the gate-on voltage VGH. The sensing pulse SENSE, the second initialization pulse INIT2, the scan pulse SCAN, and the EM pulse EM are the gate-off voltages VGL and VEL in the sensing step Ps.

In the first transmission step Ptr1, the second initialization pulse INIT2 is generated as the gate-on voltage VGH. The first initialization pulse INIT, the sensing pulse SENSE, the scan pulse SCAN, and the EM pulse EM are the gate-off voltages VGL and VEL in the first transmission step Ptr1.

In the data writing step Pwr, the scan pulse SCAN is generated as the gate-on voltage VGH synchronized with the data voltage Vdata of the pixel data. The first initialization pulse INIT, the sensing pulse SENSE, the second initialization pulse INIT2, and the EM pulse EM are generated as the gate-off voltages VGL and VEL in the data writing step Pwr.

In the second transmission step Ptr2, the sensing pulse SENSE is generated as the gate-on voltage VGH. The first initialization pulse INIT, the second initialization pulse INIT2, the scan pulse SCAN, and the EM pulse EM are the gate-off voltages VGL and VEL in the second transmission step Ptr2.

In the boosting step Pboost, the EM pulse EM is generated as the gate-on voltage VEH, and the gate signals INIT, SENSE, INIT2, and SCAN excluding the EM pulse EM are generated as the gate-off voltages VGL. In the light emission step Pem, the EM pulse EM maintains the gate-on voltage VEH, and the other gate signals INIT, SENSE, INIT2, and SCAN maintain the gate-off voltages VGL.

The light emitting element EL may be implemented with an OLED. The OLED includes an organic compound layer formed between an anode electrode and a cathode electrode. The organic compound layer may include a hole injection layer (HIL), a hole transport layer (HTL), an emission layer (EML), an electron transport layer (ETL), and an electron injection layer (EIL), but is not limited thereto. When a voltage is applied to the anode and cathode electrodes of the OLED, holes passing through the hole transport layer (HTL) and electrons passing through the electron transport layer (ETL) move to the emission layer (EML) to form excitons. In this case, visible light is emitted from the emission layer EML. The OLED used as the light emitting element EL may have a tandem structure in which a plurality of emission layers are stacked. The OLED having the tandem structure may improve the luminance and lifespan of the pixels. The anode electrode of the light emitting element EL is connected to the second electrode of a fifth switch element T5. When the fifth switch element T5 is turned on in response to the gate-on voltage VEH of the EM pulse EM, the anode electrode of the light emitting element EL is connected to the third node DTS. The low potential pixel reference voltage EVSS is applied to the cathode electrode of the light emitting element EL. The light emitting element EL includes a capacitor connected between the anode electrode and the cathode electrode. The capacitor of the light emitting element EL is omitted from the drawing.

The driving element DT generates a current according to the gate-source voltage Vgs to drive the light emitting element EL. The driving element DT includes a first electrode connected to a first node DRD, a gate electrode connected to the second node DTG, and a second electrode connected to the third node DTS. The first node DRD may be connected to the VDD line through which the pixel driving voltage EVDD is applied. An EM switch element may be added between the first node DRD and the VDD line. The EM switch element may be turned on/off in response to a second EM pulse to switch a current path between the VDD line and the first node DRD.

The first capacitor Cst1 is connected between the second node DTG and the fourth node DTS2. The second capacitor Cst2 is connected between the third node DTS and the fourth node DTS2. The third capacitor C2 is connected between the first node DRD and the third node DTS. In the first transmission step Ptr1, the first capacitor Cst1 stores a primary transmission value for transmitting the voltage of the third node DTS to the second node DTG, and transmits the data voltage Vdata of the pixel data to the second node DTG. A secondary transmission value is stored in the sum (Cst1+Cst2) of the capacitances of the first and second capacitors. The third capacitor C2 controls the primary and secondary transmission rates. The first and second capacitors Cst1 and Cst2 may be set to have a capacitance larger than that of the third capacitor C2. The second capacitor Cst2 may be set to have the same capacitance as that of the first capacitor Cst1, or may be set to have a different capacitance from that of the first capacitor Cst1.

In the present disclosure, the primary and secondary transmittance rates are adjusted by the ratio of the capacitors Cst1, Cst2, and C2 of the pixel circuit. When the voltage of the third node DTS set in the sensing step Ps is transmitted to the second node DTG, the capacitors Cst1, Cst2, and C2 allow 100% of the threshold voltage Vth of the driving element DT to be transmitted to the second node DTG in consideration of transmission loss by a parasitic capacitance Cgpara of the second node DTG.

The switch elements T1 to T5 of the pixel circuit include a first switch element T1 for supplying the data voltage Vdata of the pixel data to the fourth node DTS2 in response to the scan pulse SCAN, a second switch element T2 for supplying the initialization voltage Vinit to the second node DTG in response to the first initialization pulse INIT, a third switch element T3 for supplying the reference voltage Vref lower than the initialization voltage Vinit to the third node DTS in response to the sensing pulse SENSE, a fourth switch element T4 for supplying the reference voltage Vref to the fourth node DTS2 in response to the second initialization pulse INIT2, and the fifth switch element T5 for connecting the third node DTS to the anode electrode of the light emitting element EL in response to the EM pulse EM.

The first switch element T1 is turned on in response to the gate-on voltage VGH of the scan pulse SCAN synchronized with the data voltage Vdata of the pixel data to connect the data line DL to the fourth node DTS2, in the data writing step Pwr. The data voltage Vdata is applied to the fourth node DTS2 in the data writing step Pwr. The first switch element T1 includes a first electrode connected to the data line DL through which the data voltage Vdata is applied, a gate electrode connected to a first gate line through which the scan pulse SCAN is applied, and a second electrode connected to the fourth node DTS2.

The second switch element T2 is turned on in response to the gate-on voltage VGH of the first initialization pulse INIT to supply the initialization voltage Vinit to the second node DTG, in the initialization step Pi and the sensing step Ps. The second switch element T2 includes a first electrode connected to the INIT line through which the initialization voltage Vinit is applied, a gate electrode connected to a second gate line through which the first initialization pulse INIT is applied, and a second electrode connected to the second node DTG.

The third switch element T3 is turned on in response to the gate-on voltage VGH of the sensing pulse SENSE to supply the reference voltage Vref to the third node DTS, in the initialization step Pi. The third switch element T3 includes a first electrode connected to the third node DTS, a gate electrode connected to a third gate line through which the sensing pulse SENSE is applied, and a second electrode connected to the REF line RL through which the reference voltage Vref is applied.

The fourth switch element T4 is turned on in response to the gate-on voltage VGH of the second initialization pulse INIT2 to supply the reference voltage Vref to the fourth node DTS2, in the initialization step Pi. The fourth switch element T4 includes a first electrode connected to the fourth node DTS2, a gate electrode connected to a fourth gate line through which the second initialization pulse INIT2 is applied, and a second electrode connected to the REF line RL through which the reference voltage Vref is applied.

The fifth switch element T5 is turned on in response to the gate-on voltage VEH of the EM pulse EM to connect the third node DTS to the anode electrode of the light emitting element EL, in the boosting step Pboost and the light emission step Pem. The fifth switch element T5 includes a first electrode connected to the third node DTS, a gate electrode connected to a fifth gate line through which the EM pulse EM is applied, and a second electrode connected to the anode electrode of the light emitting element EL.

Figure 4A:
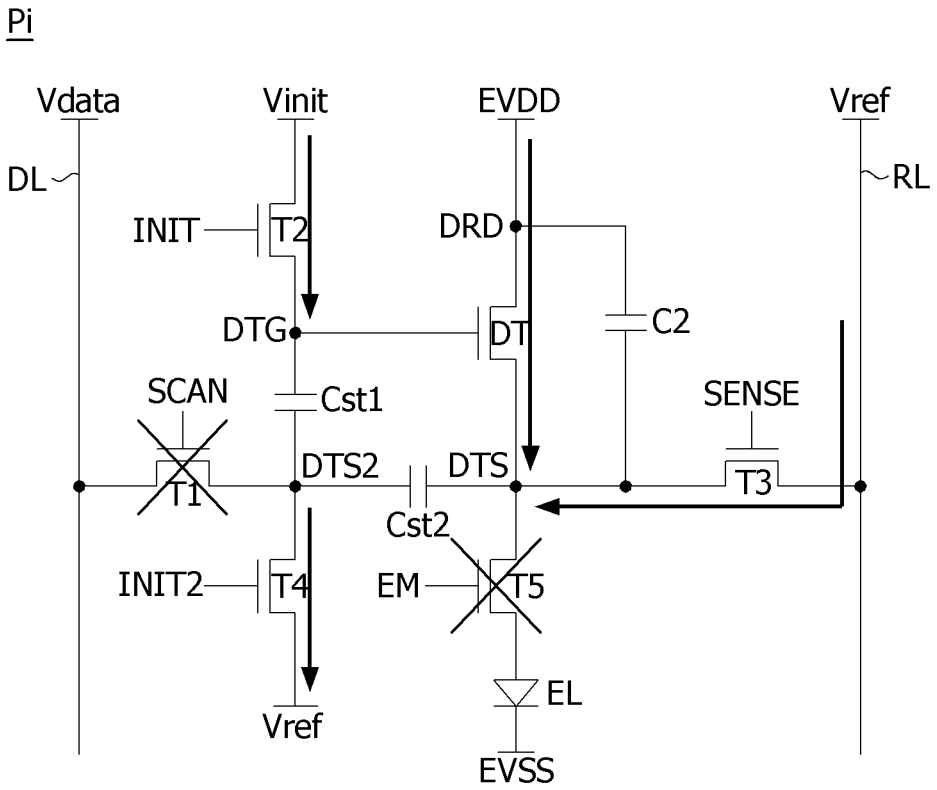
FIGS. 4A to 4F are circuit diagrams illustrating the operation of the pixel circuit shown in FIG. 1 in steps.

In the initialization step Pi, as shown in FIG. 4A, the second, third, and fourth switch elements T2, T3, and T4 and the driving element DT are turned on, and the first and fifth switch elements T1 and T5 are turned off. In this case, the light emitting element EL is not turned on. In the initialization step Pi, the main nodes of the pixel circuit are initialized. In the initialization step Pi, the voltage of the second node DTG is initialized to the initialization voltage Vinit and the voltages of the third and fourth nodes DTS and DTS2 are initialized to the reference voltage Vref. In the initialization step Pi, as shown in FIG. 3, the voltage of the third node DTS is increased from the reference voltage Vref by a current flowing through the driving element DT, and the voltages of the third node DTS and the capacitor-coupled fourth node DTS2 are also increased.

As shown in FIG. 3, the threshold voltage of the driving element DT may be shifted due to stress accumulation, e.g., positive bias temperature stress (PBTS), of the driving element DT. In the example of FIG. 3, for example, "ΔVth" in the initial state of the threshold voltage Vth represents a threshold voltage variation of the driving element DT. In the sensing step Ps, the threshold voltage Vth of the driving element DT is sampled for each pixel.

Figure 4B:
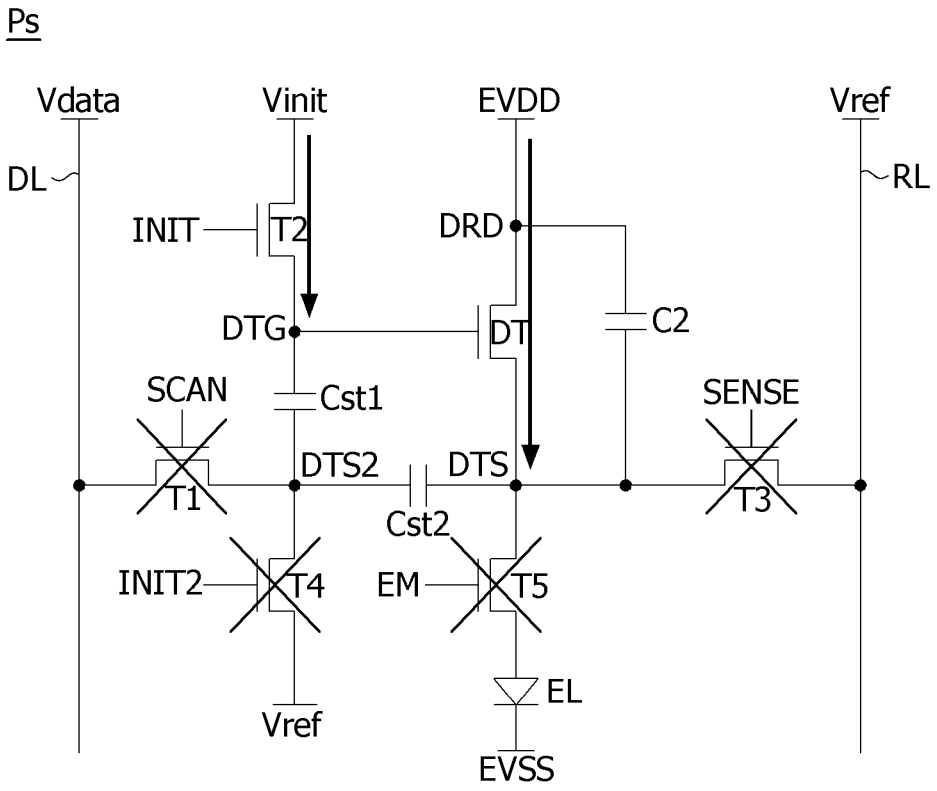

In the sensing step Ps, as shown in FIG. 4B, the second switch element T2 is turned on, while the other switch elements T1, T3, T4, and T5 except the second switch element T2 are turned off. In the sensing step Ps, when the gate-source voltage Vgs of the driving element DT reaches the threshold voltage Vth, the voltage increase of the third and fourth nodes DTS and DTS2 stops. In the sensing step Ps, the voltage of the second node DTG is maintained at the initialization voltage Vinit. At the end point of the sensing step Ps, the voltage of the third node DTS reaches a value of Vinit−Vth, and the voltage of the fourth node DTS2 is a value of A(Vinit−Vth−Vref). Here, "A" is the ratio of the first and second capacitors Cst1 and Cst2, and $$A = \frac{Cst2}{Cst1 + Cst2}.$$

Figure 4C:
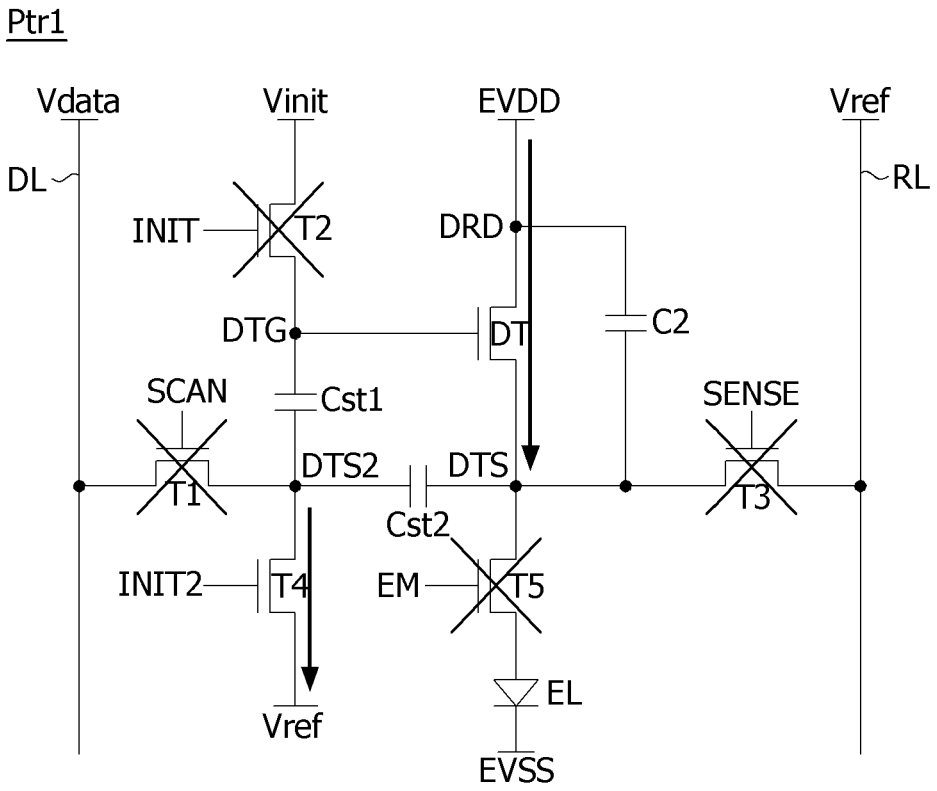

In the first transmission step Ptr1, as shown in FIG. 4C, the fourth switch element T4 is turned on, while the other switch elements T1, T2, T3, and T5 except the fourth switch element T4 are turned off. In the first transmission step Ptr1, the voltage of the fourth node DTS2 is lowered to the reference voltage Vref, and the voltage of the third node DTS is lowered to a value of Vinit−Vth−AC(Vinit−Vth−Vref). In the first transmission step Ptr1, the voltage of the third node DTS is transmitted to the second node DTG as a voltage multiplied by the capacitor ratio including the parasitic capacitance Cgpara of the second node DTG. At the end point of the first transmission step Ptr1, the voltage of the second node DTG is a value of Vinit−AB(Vinit−Vth−Vref). In the voltages of the second and third nodes DTG and DTS $$A = \frac{Cst2}{Cst + Cst2},$$

$$B = \frac{Cst1}{Cst1 + Cgpara},$$

$$C = \frac{Cst2}{Cst2 + C2}.$$

Figure 4D:
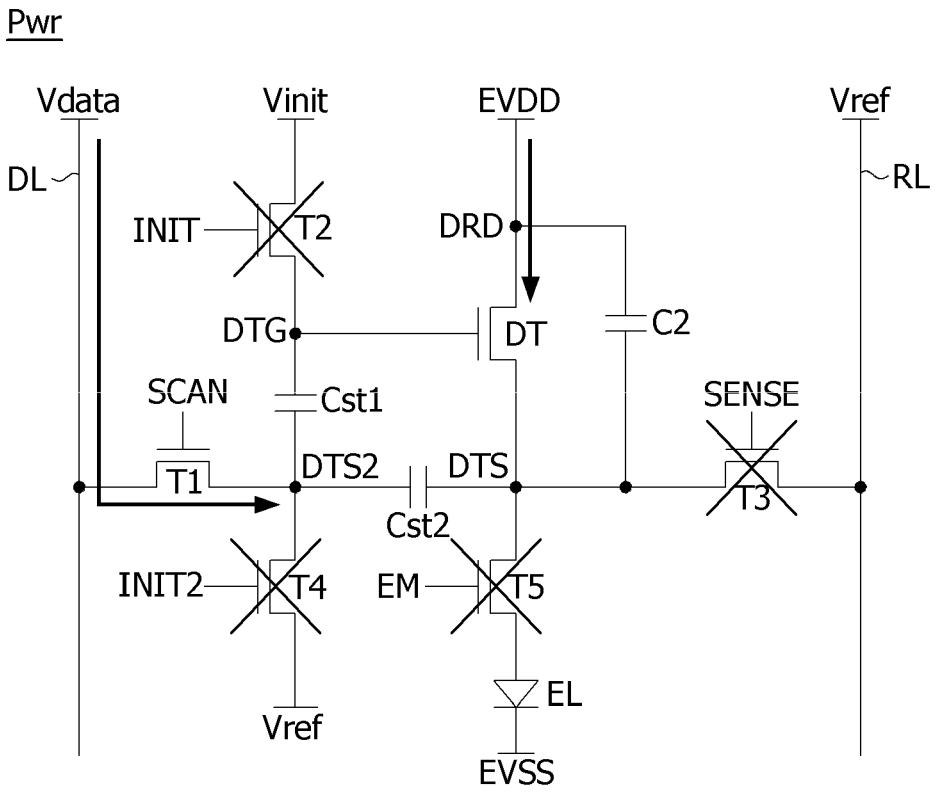

In the data writing step Pwr, as shown in FIG. 4D, the first switch element T1 is turned on, while the other switch elements T2, T3, T4, and T5 except the first switch element T1 are turned off. In this case, the data voltage Vdata of the pixel data is applied to the second node DTG, so that the voltage of the second node DTG rises and the voltages of the third and fourth nodes DTS and DTS2 capacitor-coupled to the second node DTG also rise. In the data writing step Pwr, the voltage of the fourth node DTS2 is changed to the data voltage Vdata. At the end point of the data writing step Pwr, the voltage of the second node DTG is a value of Vinit−AB (Vinit−Vth−Vref)+B(Vdata−Vref), and the voltage of the third node DTS is a value of Vinit−Vth−AC(Vinit−Vth−Vref)+C(Vdata−Vref).

Figure 4E:
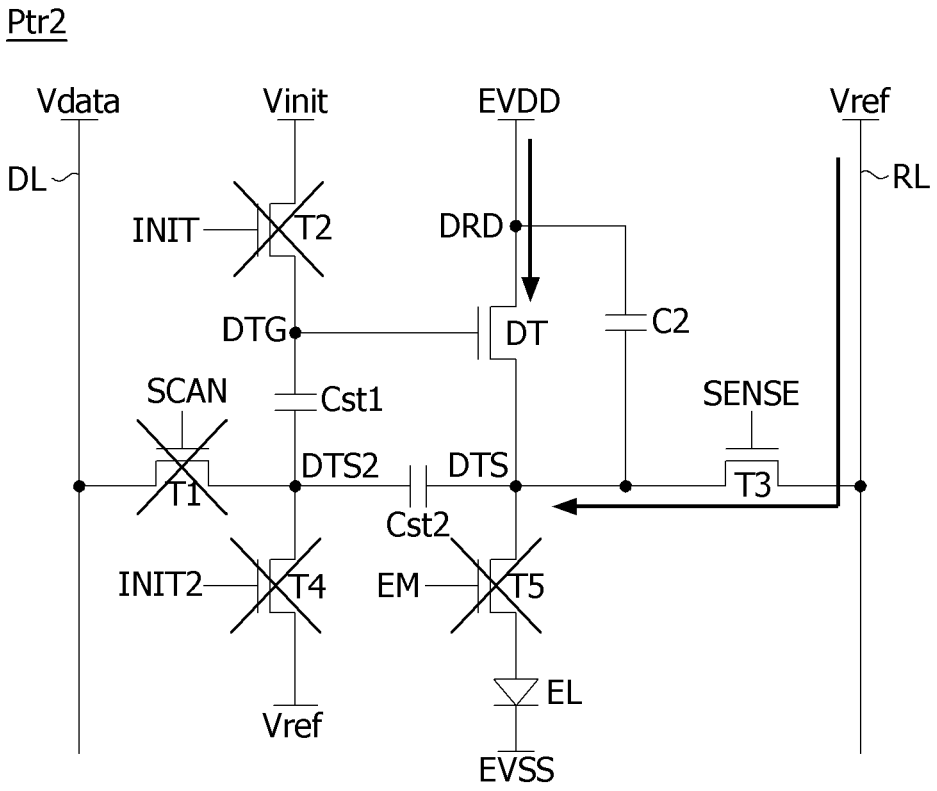

In the second transmission step Ptr2, as shown in FIG. 4E, the third switch element T3 is turned on, while the other switch elements T1, T2, T4, and T5 except the third switch element T3 are turned off. In the second transmission step Ptr2, the voltage of the third node DTS is lowered to the reference voltage Vref, and the voltage of the fourth node DTS2 capacitor-coupled to the third node DTS is also lowered. At the end point of the second transmission step Ptr2, the voltage of the second node DTG is a value of (1−AB−D+ACD)Vinit+(AB+D−ACD)Vth+(B−CD)Vdata−(AB−B−ACD+DC+D)Vref. Here, $$A = \frac{Cst2}{Cst1 + Cst2},$$

$$B = \frac{Cst1}{Cst1 + Cgpara},$$

$$C = \frac{Cst2}{Cst2 + C2},$$

$$D = \frac{\frac{Cst1Cst2}{Cst1 + Cst2}}{\frac{Cst1Cst2}{Cst1 + Cst2} + Cgpara}.$$

Figure 4F:
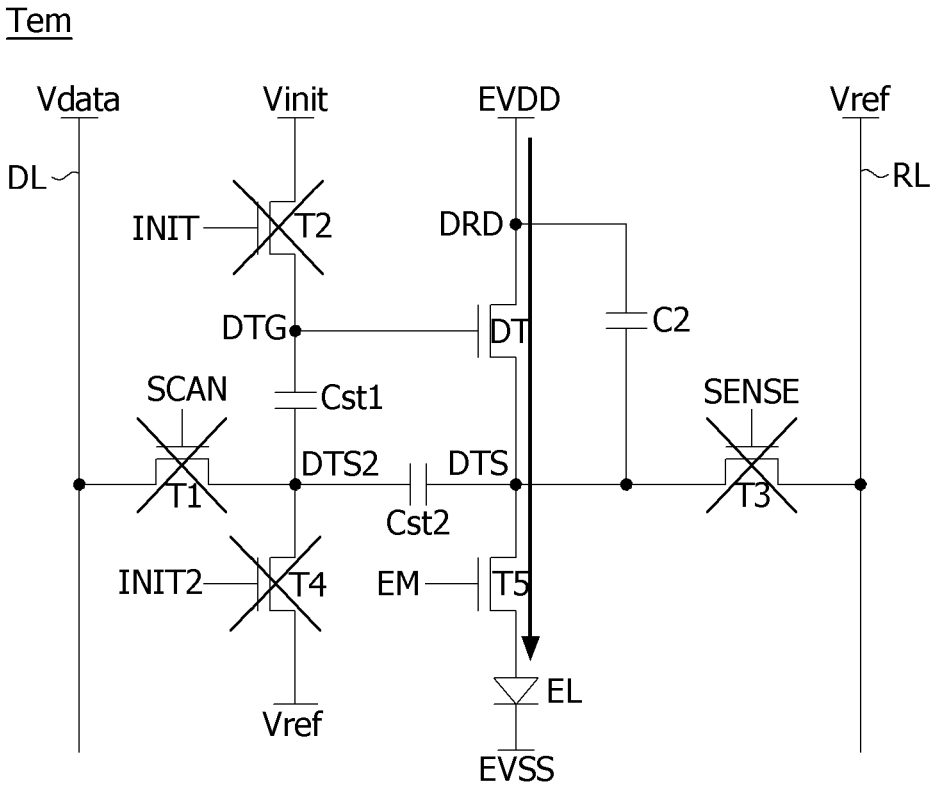

During the boosting step Pboost, as shown in FIG. 4F, the fifth switch element T5 is turned on, and the other switch elements T1, T2, T3, and T4 except the fifth switch element T5 are turned off. During the boosting step Pboost, the voltage of the third node DTS rises, and the voltages of the second and fourth nodes DTG and DTS2 which have been floated also rise. In the boosting step Pboost, the capacitor of the light emitting element EL is charged. In the light emission step Pem, as shown in FIG. 4F, a current generated according to the gate-source voltage Vgs of the driving element DT flows through the light emitting element EL, so that the light emitting element EL may emit light.

The gate signals INIT, INIT2, SENSE, and SCAN except the EM pulse EM are the gate-off voltages VGL. During the boosting step Pboost, the voltages of the second to fourth nodes DTG, DTS, and DTS2 which have been floated rise.

In the light emission step Pem, as shown in FIG. 4F, the fifth switch element T5 maintains an on state, and the first, second, third and fourth switch elements T1 to T4 maintain an off state. In this case, a current generated according to the gate-source voltage Vgs of the driving element DT, i.e., the voltage between the second and third nodes may be supplied to the light emitting element EL to allow the light emitting element EL to emit light.

In the present disclosure, the voltage of the third node DTS is transmitted to the second node DTG in the first and second transmission steps Ptr1 and Ptr2 in consideration of the parasitic capacitance Cgpara of the second node DTG, thereby improving the threshold voltage compensation performance of the device DT and increasing a compensation range.

Figure 5:
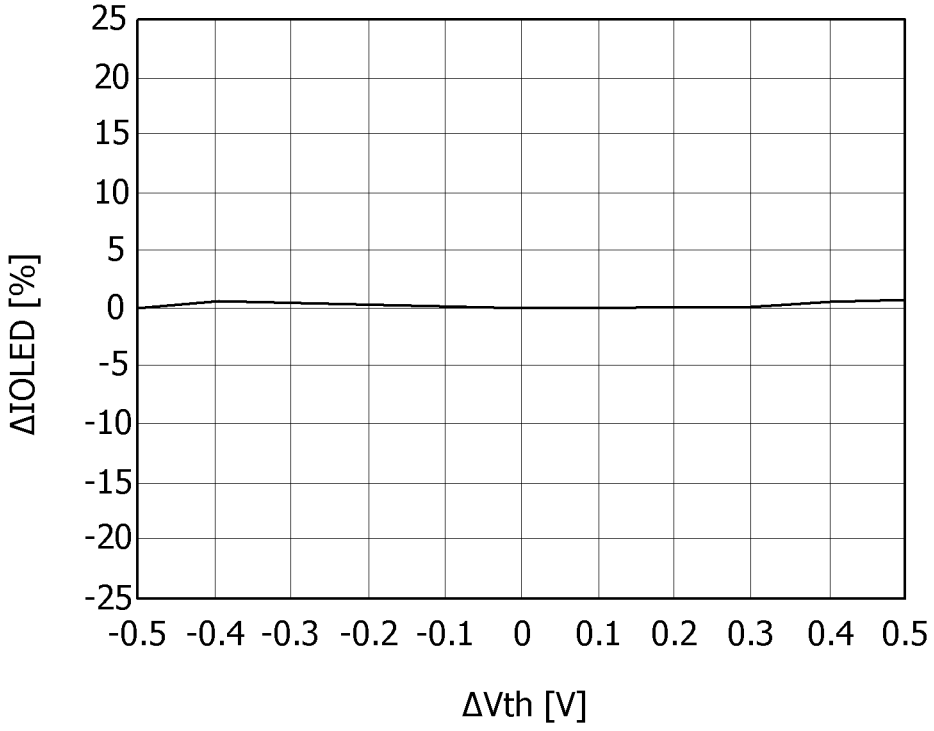
FIG. 5 illustrates a simulation result for verifying a threshold voltage compensation effect of a driving element in the pixel circuit of the present disclosure.

FIG. 5 is a simulation result for verifying a threshold voltage compensation effect of the driving element DT in the pixel circuit of the present disclosure. In this simulation, the capacitors Cst1, Cst2, and C2 are set to 100 [f], 100 [f], and 40 [f], respectively. In FIG. 5, the horizontal axis represents the threshold voltage variation ΔVth of the driving element DT, and the vertical axis represents a current variation ΔIOLED flowing through the light emitting element EL. As can be seen from FIG. 5, the simulation result shows that even when the threshold voltage Vth of the driving element DT in the pixel circuit of the present disclosure is greatly changed, the current amount of the light emitting element EL is constant and thus the threshold voltage Vth of the driving element DT can be compensated in a wide compensation range.

Figure 6:
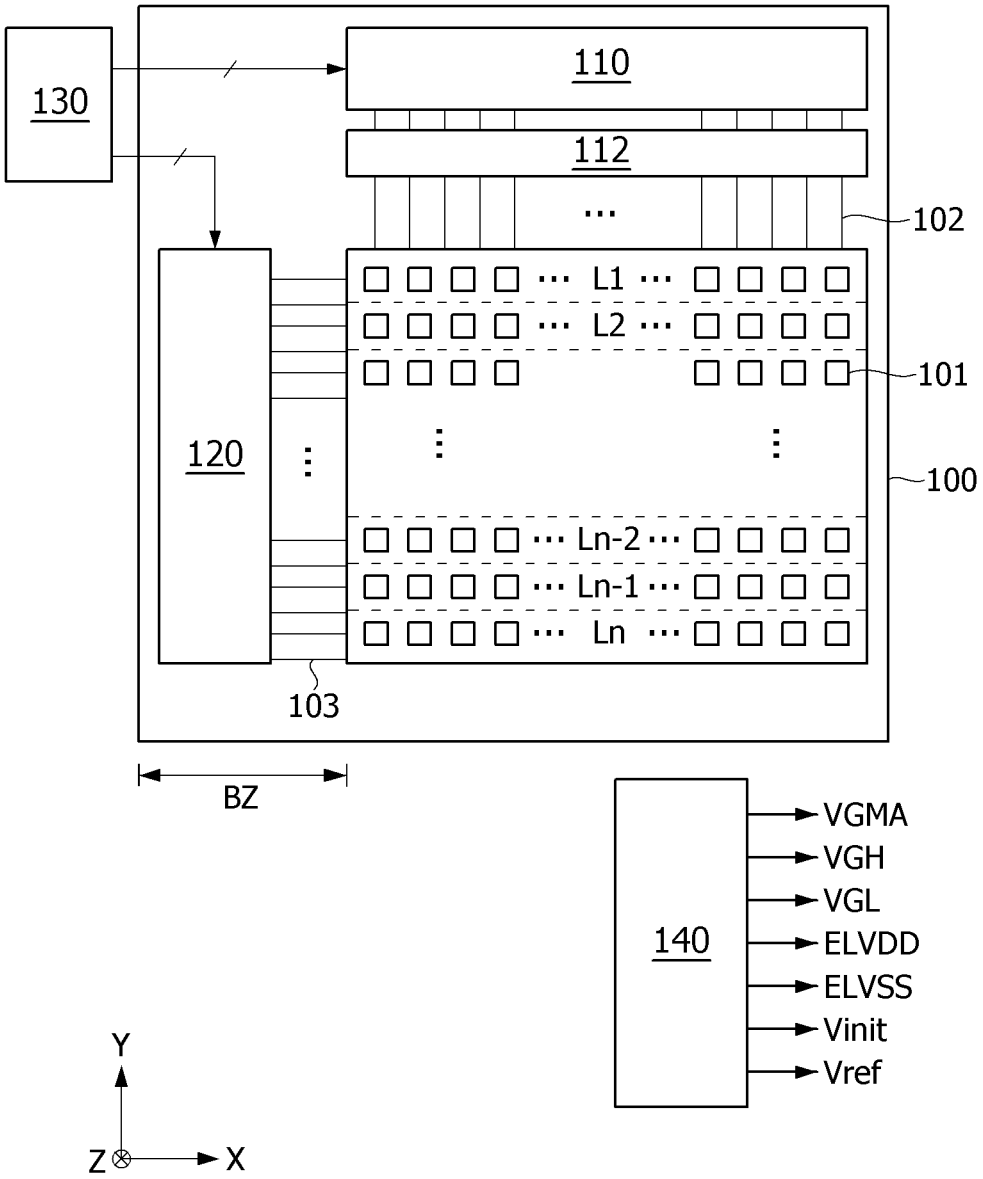
FIG. 6 is a block diagram illustrating a display device according to an embodiment of the present disclosure.
Figure 7:
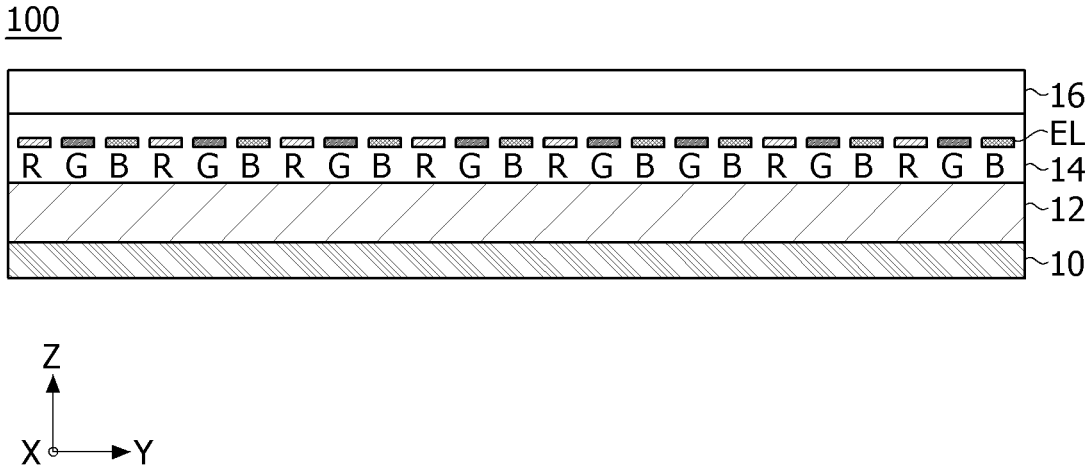
FIG. 7 is a cross-sectional view illustrating a cross-sectional structure of a display panel shown in FIG. 6.

FIG. 6 is a block diagram illustrating a display device according to an embodiment of the present disclosure. FIG. 7 is a cross-sectional view illustrating a cross-sectional structure of a display panel shown in FIG. 6.

Referring to FIGS. 6 and 7, the display device according to an embodiment of the present disclosure includes a display panel 100, a display panel driver for writing pixel data to pixels of the display panel 100, and a power supply 140 for generating power beneficial to drive the pixels and the display panel driver.

The display panel 100 may be a display panel of a rectangular structure having a length in an X-axis direction, a width in a Y-axis direction and a thickness in a Z-axis direction. The display panel 100 includes a pixel array that displays an input image on a screen. The pixel array includes a plurality of data lines 102, a plurality of gate lines 103 crossing the plurality of data lines 102, and pixels arranged in a matrix. The display panel 100 may further include power lines commonly connected to the pixels. The power lines supply a constant voltage or DC voltage beneficial for driving the pixels 101 to the pixels 101. The power lines may include a VDD line through which a pixel driving voltage EVDD is applied, an INIT line through which an initialization voltage Vinit is applied, REF line through which a reference voltage Vref is applied, and a VSS line through which a low potential power supply voltage ELVSS is applied.

A cross-sectional structure of the display panel 100 includes a circuit layer 12, a light-emitting element layer 14, and an encapsulation layer 16 that are stacked on a substrate 10 as shown in FIG. 7.

The circuit layer 12 may include a thin-film transistor (TFT) array including a pixel circuit connected to interconnections such as a data line, a gate line, a power line, and the like, a de-multiplexer array 112, a gate driver 120, and the like. An interconnection and circuit elements of the circuit layer 12 may include a plurality of insulating layers, two or more metal layers separated from each other with the insulating layers therebetween, and an active layer including a semiconductor material. All transistors formed in the circuit layer 12 may be embodied as n-channel oxide TFTs.

The light-emitting element layer 14 may include light-emitting elements EL driven by the pixel circuit. The light-emitting elements EL may include a red (R) light-emitting element, a green (G) light-emitting element, and a blue (B) light-emitting element. In another embodiment, the light-emitting element layer 14 may include a white light-emitting element and a color filter. The light-emitting elements EL of the light-emitting element layer 14 may be covered with a multi-layered protective layer including an organic film and an inorganic film.

The encapsulation layer 16 covers the light-emitting element layer 14 to seal the circuit layer 12 and the light-emitting element layer 14. The encapsulation layer 16 may be a multi-insulating film structure in which an organic film and an inorganic film are alternately stacked. The inorganic film blocks infiltration of moisture or oxygen. The organic film planarizes a surface of the inorganic film. When the organic film and the inorganic film are stacked in multiple layers, a moving path of moisture or oxygen is longer than that of a single layer and thus the infiltration of moisture and oxygen that may influence the light-emitting element layer 14 may be effectively blocked.

Although not shown, a touch sensor layer is formed on the encapsulation layer 16 and a polarizing plate or a color filter layer may be disposed on the touch sensor layer. The touch sensor layer may include capacitance touch sensors that sense a touch input on the basis of a change in capacitance before and after the touch input is input. The touch sensor layer may include metal interconnection patterns and insulating films that form a capacity of the touch sensors. The insulating films may insulate intersections of the metal interconnection patterns and planarize a surface of the touch sensor layer. The polarizing plate may convert polarization of external light reflected from the metals of the touch sensor layer and the circuit layer to improve visibility and a contrast ratio. The polarizing plate may be embodied as a polarizing plate or circular polarizing plate in which a linear polarizing plate and a phase-delay film are bonded with each other. Cover glass may be adhered on the polarizing plate. The color filter layer may include red, green, and blue color filters. The color filter layer may further include a black matrix pattern. The color filter layer may absorb some light reflected from the circuit layer and the touch sensor layer instead of the polarizing plate and increase the color purity of an image reproduced on the pixel array.

The pixel array includes a plurality of pixel lines L1 to Ln. Each of the pixel lines L1 to Ln includes pixels in a first line that are arranged on the pixel array of the display panel 100 in a direction of lines (X-axis direction). Pixels arranged in a first pixel line share the gate lines 103. Subpixels arranged in a column direction Y along a data-line direction share the same data line 102. One horizontal period is a time obtained by dividing a first frame period by the total number of the pixel lines L1 to Ln.

The display panel 100 may be embodied as a non-transmissive display panel or a transmissive display panel. The transmissive display panel is applicable to a transparent display device in which an image is displayed on a screen and through which a real background is visible. The display panel 100 may be manufactured as a flexible display panel.

Each of the pixels 101 may include a red sub-pixel, a green sub-pixel, and a blue sub-pixel for color reproduction. Each of the pixels may further include a white sub-pixel. Each of the sub-pixels may include the pixel circuit shown in FIGS. 2 to 4F. Hereinafter, a pixel may be interpreted as having the same meaning as a sub-pixel. Each of the pixel circuits is connected to the data lines, the gate lines, and the power lines.

The pixels may be arranged as real color pixels and pentile pixels. The pentile pixel may realize a higher resolution than a real color pixel by driving two sub-pixels having different colors as one pixel 101 by using a preset pixel rendering algorithm. The pixel rendering algorithm may compensate for insufficient color representation in each pixel with the color of light emitted from an adjacent pixel.

The power supply unit (or "power supply") 140 generates a DC voltage (or constant voltage) beneficial for driving the pixel array of the display panel 100 and a display panel driver by using a DC-DC converter. The DC-DC converter may include a charge pump, a regulator, a buck converter, a boost converter, and the like. The power supply unit 140 may adjust the level of a DC input voltage applied from a host system (not shown) to generate constant voltages such as a gamma reference voltage VGMA, the gate-on voltages VGH and VEH, the gate-off voltages VGL and VEL, the pixel driving voltage EVDD, the low potential pixel reference voltage EVSS, the initialization voltage Vinit, and the reference voltage Vref. The gamma reference voltage VGMA is supplied to a data driver 110. The gate-on voltages VGH and VEH and the gate-off voltages VGL and VEL are supplied to the gate driver 120. The constant voltages such as the pixel driving voltage EVDD, the low potential pixel reference voltage EVSS, the initialization voltage Vinit, and the reference voltage Vref are supplied to the pixels 101 through the power lines commonly connected to the pixels 101.

The display panel driver writes pixel data of an input image to the pixels of the display panel 100 under the control of the timing controller 130.

The display panel driver includes the data driver 110 and the gate driver 120. The display panel driver may further include a demultiplexer array 112 disposed between the data driver 110 and the data lines 102.

The demultiplexer array 112 sequentially supplies the data voltages outputted from the channels of the data driver 110 to the data lines 102 using a plurality of demultiplexers DEMUX. The demultiplexer may include a plurality of switch elements disposed on the display panel 100. When the demultiplexer is disposed between the data lines 102 and the output terminals of the data driver 110, the number of channels of the data driver 110 may be reduced. The demultiplexer array 112 may be omitted.

The display panel driver may further include a touch sensor driver for driving the touch sensors. The touch sensor driver is omitted from FIG. 6. The data driver 110 and the touch sensor driver may be integrated into one drive integrated circuit (IC). In a mobile device or a wearable device, the timing controller 130, the power supply unit 140, the data driver 110, and the like may be integrated into one drive IC.

The display panel driver may operate in a low speed driving mode under the control of the timing controller 130. The low speed driving mode may be set to reduce power consumption of the display device when an input image does not change by a preset number of frames as a result of analyzing the input image. In the low speed driving mode, power consumption of the display panel driver and the display panel 100 may be reduced by lowering a refresh rate of pixels when a still image is inputted for a predetermined or selected time or longer. The low speed driving mode is not limited to when a still image is inputted. For example, when the display device operates in a standby mode or when a user command or an input image is not inputted to the display panel driver for a predetermined or selected time or longer, the display panel driver may operate in the low speed driving mode.

The data driver 110 receives the pixel data of the input image received as a digital signal from the timing controller 130 and outputs a data voltage. The data driver 110 converts the pixel data of the input image into a gamma compensation voltage every frame period using a digital to analog converter (DAC) to generate the data voltage Vdata. The gamma reference voltage VGMA includes a gamma compensation voltage for each grayscale through a voltage divider circuit. The gamma compensation voltage for each grayscale is provided to the DAC of the data driver 110. The data voltage Vdata is outputted from each of the channels of the data driver 110 through an output buffer.

The gate driver 120 may be implemented as a gate in panel (GIP) circuit formed in a circuit layer 12 on the display panel 100 together with wires and a TFT array of the pixel array. The gate driver 120 may be disposed in a bezel BZ, which is the non-display area of the display panel 100, or may be distributedly disposed in the pixel array where the input image is reproduced. The gate driver 120 sequentially outputs the gate signal to the gate lines 103 under the control of the timing controller 130. The gate driver 120 may shift the gate signal by using a shift register to sequentially supply the signals to the gate lines 103. The gate signal may include various gate pulses such as the scan pulse, the sensing pulse, the first initialization pulse, the second initialization pulse, and the EM pulse.

In order to drive the pixel circuit shown in FIG. 1, the gate driver 120 may include a first shift register sequentially outputting the scan pulse SCAN, a second shift register sequentially outputting the sensing pulse SENSE, a third shift register sequentially outputting the first initialization pulse INIT, a fourth shift register sequentially outputting the second initialization pulse INIT2, and a fifth shift register sequentially outputting the EM pulse EM.

The timing controller 130 receives digital video data DATA of the input image and a timing signal synchronized with the digital video data DATA from the host system. The timing signal may include a vertical synchronization signal Vsync, a horizontal synchronization signal Hsync, a clock CLK, a data enable signal DE, and the like. Since a vertical period and a horizontal period can be known by counting the data enable signal DE, the vertical synchronization signal Vsync and the horizontal synchronization signal Hsync may be omitted. The data enable signal DE has a cycle of one horizontal period 1H.

The host system may be any one of a television (TV) system, a tablet computer, a laptop computer, a navigation system, a personal computer (PC), a home theater system, a mobile device, a wearable device, and a vehicle system. The host system may scale an image signal from a video source to fit the resolution of the display panel 100 and transmit it to the timing controller 130 together with the timing signal.

In a normal driving mode, the timing controller 130 may multiply an input frame frequency by i (i being a natural number) times to control the operation timing of the display panel driver with a frame frequency of the input frame frequency xi Hz. The input frame frequency is 60 Hz in a national television standards committee (NTSC) method and 50 Hz in a phase-alternating line (PAL) method.

The timing controller 130 lowers the frequency of the frame rate at which pixel data is written to pixels in the low speed driving mode than in the normal driving mode. For example, a data refresh frame frequency at which pixel data is written to pixels in the normal driving mode may be generated at a frequency of 60 Hz or higher, e.g., a refresh rate of any one of 60 Hz, 120 Hz, and 144 Hz, and a data refresh frame DRF in the low speed driving mode may be generated at a refresh rate of a lower frequency than that of the normal driving mode. The timing controller 130 may lower the driving frequency of the display panel driver by lowering the frame frequency to a frequency between 1 Hz and 30 Hz in order to lower the refresh rate of the pixels in the low speed driving mode.

Based on the timing signal Vsync, Hsync, and DE received from the host system, the timing controller 130 generates a data timing control signal for controlling the operation timing of the data driver 110, a control signal for controlling the operation timing of the demultiplexer array 112, and a gate timing control signal for controlling the operation timing of the gate driver 120. The timing controller 130 controls the operation timing of the display panel driver to synchronize the data driver 110, the demultiplexer array 112, the touch sensor driver, and the gate driver 120.

The gate timing control signal generated from the timing controller 130 may be inputted to the shift registers of the gate driver 120 through a level shifter (not shown). The level shifter may receive the gate timing control signal to generate a start pulse and a shift clock, and provide it to the shift registers of the gate driver 120.

The objects to be achieved by the present disclosure, the means for achieving the objects, and effects of the present disclosure described above do not specify essential features of the claims, and thus, the scope of the claims is not limited to the disclosure of the present disclosure.

Although the embodiments of the present disclosure have been described in more detail with reference to the accompanying drawings, the present disclosure is not limited thereto and may be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts of the embodiments and equivalents thereof should be construed as falling within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A pixel circuit comprising:

a driving element including a first electrode connected to a first node to which a pixel driving voltage is applied, a gate electrode connected to a second node, and a second electrode connected to a third node, and configured to supply a current to a light emitting element;

a first switch element configured to supply a data voltage of pixel data to a fourth node in response to a scan pulse;

a second switch element configured to supply an initialization voltage to the second node in response to a first initialization pulse;

a third switch element configured to supply a reference voltage lower than the initialization voltage to the third node in response to a sensing pulse;

a fourth switch element configured to supply the reference voltage to the fourth node in response to a second initialization pulse;

a fifth switch element configured to connect the third node to an anode electrode of the light emitting element in response to an emission control pulse;

a first capacitor connected between the second node and the fourth node;

a second capacitor connected between the third node and the fourth node; and a third capacitor connected between the first node and the third node;

wherein a driving period of the pixel circuit includes an initialization step, a sensing step, a first transmission step, a data writing step, a second transmission step, a boosting step, and a light emission step;

wherein in the first transmission step, the second initialization pulse is generated as the gate-on voltage, and the first initialization pulse, the sensing pulse, the scan pulse, and the emission control pulse are generated as the gate-off voltage;

wherein in the data writing step, the scan pulse is generated as the gate-on voltage synchronized with the data voltage, and the first initialization pulse, the sensing pulse, the second initialization pulse, and the emission control pulse are generated as the gate-off voltage;

wherein in the second transmission step, the sensing pulse is generated as the gate-on voltage, and the first initialization pulse, the second initialization pulse, the scan pulse, and the emission control pulse are generated as the gate-off voltage;

wherein each of the first, second, third, fourth and fifth switch elements is turned on in response to the gate-on voltage and is turned off in response to the gate-off voltage.

2. The pixel circuit of claim 1, wherein a capacitance of each of the first and second capacitors is greater than that of the third capacitor.

3. The pixel circuit of claim 1, wherein the pixel driving voltage is higher than the data voltage and the initialization voltage, a gate-on voltage of each of the scan pulse, the first initialization pulse, the sensing pulse, the second initialization pulse, and the emission control pulse is higher than the pixel driving voltage, and a gate-off voltage of each of the scan pulse, the first initialization pulse, the sensing pulse, the second initialization pulse, and the emission control pulse is lower than the reference voltage.

4. The pixel circuit of claim 3, wherein the anode electrode of the light emitting element is connected to the fifth switch element, and the light emitting element further includes:

a cathode electrode to which a low potential pixel reference voltage lower than the reference voltage is applied.

5. The pixel circuit of claim 1, wherein the first switch element includes a first electrode to which the data voltage is applied, a gate electrode to which the scan pulse is applied, and a second electrode connected to the fourth node, the second switch element includes a first electrode to which the initialization voltage is applied, a gate electrode to which the first initialization pulse is applied, and a second electrode connected to the second node, the third switch element includes a first electrode connected to the third node, a gate electrode to which the sensing pulse is applied, and a second electrode to which the reference voltage is applied, the fourth switch element includes a first electrode connected to the fourth node, a gate electrode to which the second initialization pulse is applied, and a second electrode to which the reference voltage is applied, and the fifth switch element includes a first electrode connected to the third node, a gate electrode to which the emission control pulse is applied, and a second electrode connected to the anode electrode of the light emitting element.

6. The pixel circuit of claim 1, in the initialization step, the first initialization pulse, the sensing pulse, and the second initialization pulse are generated as a gate-on voltage, and the scan pulse and the emission control pulse are generated as a gate-off voltage, in the sensing step, the first initialization pulse is generated as the gate-on voltage, and the sensing pulse, the second initialization pulse, the scan pulse, and the emission control pulse are generated as the gate-off voltage, in the boosting step and the light emission step, the emission control pulse is generated as the gate-on voltage, and the first initialization pulse, the sensing pulse, the second initialization pulse, and the scan pulse are generated as the gate-off voltage.

7. A display device comprising:

a display panel on which a plurality of pixel circuits are disposed;

a data driver configured to generate a data voltage of pixel data; and a gate driver configured to generate a first initialization pulse, a sensing pulse, a second initialization pulse, a scan pulse, and an emission control pulse to apply to gate lines, wherein each of the pixel circuits includes:

a driving element including a first electrode connected to a first node to which a pixel driving voltage is applied, a gate electrode connected to a second node, and a second electrode connected to a third node, and configured to supply a current to a light emitting element;

a first switch element configured to supply the data voltage of the pixel data to a fourth node in response to the scan pulse;

a second switch element configured to supply an initialization voltage to the second node in response to the first initialization pulse;

a third switch element configured to supply a reference voltage lower than the initialization voltage to the third node in response to the sensing pulse;

a fourth switch element configured to supply the reference voltage to the fourth node in response to the second initialization pulse;

a fifth switch element configured to connect the third node to an anode electrode of the light emitting element in response to the emission control pulse;

a first capacitor connected between the second node and the fourth node;

a second capacitor connected between the third node and the fourth node; and a third capacitor connected between the first node and the third node;

wherein the reference voltage supplied to the third switch element and the fourth switch element has a same voltage level.

8. The display device of claim 7, wherein a capacitance of each of the first and second capacitors is greater than that of the third capacitor.

9. The display device of claim 7, wherein the pixel driving voltage is higher than the data voltage and the initialization voltage, a gate-on voltage of each of the scan pulse, the first initialization pulse, the sensing pulse, the second initialization pulse, and the emission control pulse is higher than the pixel driving voltage, and a gate-off voltage of each of the scan pulse, the first initialization pulse, the sensing pulse, the second initialization pulse, and the emission control pulse is lower than the reference voltage.

10. The display device of claim 9, wherein the anode electrode of the light emitting element is connected to the fifth switch element, and the light emitting element further includes:

a cathode electrode to which a low potential pixel reference voltage lower than the reference voltage is applied.

11. The display device of claim 7, wherein a driving period of the pixel circuit includes an initialization step, a sensing step, a first transmission step, a data writing step, a second transmission step, a boosting step, and a light emission step, in the initialization step, the first initialization pulse, the sensing pulse, and the second initialization pulse are generated as a gate-on voltage, and the scan pulse and the emission control pulse are generated as a gate-off voltage, in the sensing step, the first initialization pulse is generated as the gate-on voltage, and the sensing pulse, the second initialization pulse, the scan pulse, and the emission control pulse are generated as the gate-off voltage, in the first transmission step, the second initialization pulse is generated as the gate-on voltage, and the first initialization pulse, the sensing pulse, the scan pulse, and the emission control pulse are generated as the gate-off voltage, in the data writing step, the scan pulse is generated as the gate-on voltage synchronized with the data voltage, and the first initialization pulse, the sensing pulse, the second initialization pulse, and the emission control pulse are generated as the gate-off voltage, in the second transmission step, the sensing pulse is generated as the gate-on voltage, and the first initialization pulse, the second initialization pulse, the scan pulse, and the emission control pulse are generated as the gate-off voltage, in the boosting step and the light emission step, the emission control pulse is generated as the gate-on voltage, and the first initialization pulse, the sensing pulse, the second initialization pulse, and the scan pulse are generated as the gate-off voltage, and each of the first, second, third, fourth and fifth switch elements is turned on in response to the gate-on voltage and is turned off in response to the gate-off voltage.

12. The display device of claim 7, wherein the driving element of the pixel circuit and each of the first, second, third, fourth and fifth switch elements include transistors, and wherein the display panel includes a circuit layer in which the pixel circuit and the gate driver are formed, and a light emitting element layer disposed on the circuit layer and including the light emitting element.

13. The display device of claim 12, wherein all transistors of the circuit layer are n-channel oxide transistors.

14. A display device comprising:

a display panel on which a plurality of pixel circuits are disposed;

a data driver configured to generate a data voltage of pixel data; and a gate driver configured to generate a first initialization pulse, a sensing pulse, a second initialization pulse, a scan pulse, and an emission control pulse to apply to gate lines, wherein each of the pixel circuits includes:

a driving element including a first electrode connected to a first node to which a pixel driving voltage is applied, a gate electrode connected to a second node, and a second electrode connected to a third node, and configured to supply a current to a light emitting element;

a first switch element configured to supply the data voltage of the pixel data to a fourth node in response to the scan pulse;

a second switch element configured to supply an initialization voltage to the second node in response to the first initialization pulse;

a third switch element configured to supply a reference voltage lower than the initialization voltage to the third node in response to the sensing pulse, the reference voltage being a constant voltage;

a fourth switch element configured to supply the reference voltage to the fourth node in response to the second initialization pulse;

a fifth switch element configured to connect the third node to an anode electrode of the light emitting element in response to the emission control pulse;

a first capacitor connected between the second node and the fourth node;

a second capacitor connected between the third node and the fourth node; and a third capacitor connected between the first node and the third node.

15. The display device of claim 14, wherein a capacitance of each of the first and second capacitors is greater than that of the third capacitor.

16. The display device of claim 14, wherein the pixel driving voltage is higher than the data voltage and the initialization voltage, a gate-on voltage of each of the scan pulse, the first initialization pulse, the sensing pulse, the second initialization pulse, and the emission control pulse is higher than the pixel driving voltage, and a gate-off voltage of each of the scan pulse, the first initialization pulse, the sensing pulse, the second initialization pulse, and the emission control pulse is lower than the reference voltage.

17. The display device of claim 16, wherein the anode electrode of the light emitting element is connected to the fifth switch element, and the light emitting element further includes:

a cathode electrode to which a low potential pixel reference voltage lower than the reference voltage is applied.

18. The display device of claim 14, wherein a driving period of the pixel circuit includes an initialization step, a sensing step, a first transmission step, a data writing step, a second transmission step, a boosting step, and a light emission step, in the initialization step, the first initialization pulse, the sensing pulse, and the second initialization pulse are generated as a gate-on voltage, and the scan pulse and the emission control pulse are generated as a gate-off voltage, in the sensing step, the first initialization pulse is generated as the gate-on voltage, and the sensing pulse, the second initialization pulse, the scan pulse, and the emission control pulse are generated as the gate-off voltage, in the first transmission step, the second initialization pulse is generated as the gate-on voltage, and the first initialization pulse, the sensing pulse, the scan pulse, and the emission control pulse are generated as the gate-off voltage, in the data writing step, the scan pulse is generated as the gate-on voltage synchronized with the data voltage, and the first initialization pulse, the sensing pulse, the second initialization pulse, and the emission control pulse are generated as the gate-off voltage, in the second transmission step, the sensing pulse is generated as the gate-on voltage, and the first initialization pulse, the second initialization pulse, the scan pulse, and the emission control pulse are generated as the gate-off voltage, in the boosting step and the light emission step, the emission control pulse is generated as the gate-on voltage, and the first initialization pulse, the sensing pulse, the second initialization pulse, and the scan pulse are generated as the gate-off voltage, and each of the first, second, third, fourth and fifth switch elements is turned on in response to the gate-on voltage and is turned off in response to the gate-off voltage.

19. The display device of claim 14, wherein the driving element of the pixel circuit and each of the first, second, third, fourth and fifth switch elements include transistors, and wherein the display panel includes a circuit layer in which the pixel circuit and the gate driver are formed, and a light emitting element layer disposed on the circuit layer and including the light emitting element.

20. The display device of claim 19, wherein all transistors of the circuit layer are n-channel oxide transistors.

* * * * *